United States Patent [19]

Focke

[11] 3,986,607

[45] Oct. 19, 1976

[54] PACK OF A FOLDABLE MATERIAL, MORE PARTICULARLY A CIGARETTE PACK

[75] Inventor: Heinz Focke, Verden, Aller, Germany

[73] Assignee: Focke & Pfuhl, Verden, Aller, Germany

[22] Filed: Dec. 6, 1974

[21] Appl. No.: 530,108

[30] Foreign Application Priority Data

Dec. 6, 1973 Germany ..... 2360701

[52] U.S. Cl. ..... 206/245; 206/268; 206/273; 229/44 CB

[51] Int. Cl.[2] ..... B65D 85/10; B65D 77/02

[58] Field of Search ..... 206/245, 271, 273, 275, 206/268; 229/37 R, 44 R, 44 CB, 51 C, 87 C, 48 R, 14 BW

[56] References Cited

UNITED STATES PATENTS

| | | | |
|---|---|---|---|
| 837,324 | 12/1906 | Mitchell | 229/14 BW |
| 2,163,828 | 6/1939 | Chalmers | 229/44 R |
| 2,330,045 | 9/1943 | Georgiou | 229/48 R |

*Primary Examiner*—William T. Dixson, Jr.
*Attorney, Agent, or Firm*—Sughrue, Rothwell, Mion, Zinn and Macpeak

[57] ABSTRACT

A "flip-top" cigarette pack includes a front wall 10 having outer side flaps 15 hinged thereto and a back wall 11 having inner side flaps 14 hinged thereto. A U-shaped insert collar 16 provided with side flaps 17 is fitted within the pack, and a foil wrapper 20 enclosing the cigarettes is fitted within both the pack and the insert collar. The side flap 14 has apertures 18 and 21. The foil wrapper is secured to the folded down flap 15 by adhesive 22 through aperture 21, while a preformed projection 19 on flap 17 engages the adhesive through aperture 18 to lock the insert collar rigidly in place.

2 Claims, 3 Drawing Figures

PACK OF A FOLDABLE MATERIAL, MORE PARTICULARLY A CIGARETTE PACK

The invention relates to a pack of a foldable material, more particularly a cigarette pack, having in partial zones at least three layers of packing material, the layers being disposed one above another and being joined together.

A number of packing material layers disposed one above another are found in a wide variety of packs, more particularly in so-called hard packs for cigarettes. The layers have to be joined together also, as another way of providing a multi-layer type of pack, extra blanks are provided either in the pack or as an outer covering, more particularly in the case of the tinfoil blank which is conventionally used to wrap the cigarettes in cigarette packs.

Clearly, it becomes unusually difficult to join the layers together if there are more than two layers to be joined together, more particularly by sticking. Accordingly, it is an object of the invention to provide a pack in which more than two, more particularly three, layers of the pack can be joined together relatively simply.

The invention accordingly provides a pack wherein an inner layer is directly connected to the outer layer near an interruption, more particularly a recess, in the central layer.

The underlying idea of the invention is, therefore, directly to join together, more particularly by sticking, two or possibly more layers, separated from one another by a central layer, near a recess in the central layer, the same automatically being held between the layers which it is particularly required to enclose. Also, the central layer can be joined to one or the other of the outer layers.

The invention can be used with great advantages for hard packs for cigarettes. The invention can also be used to locate a tinfoil blank in a pack. It is unnecessary in this case to stamp the highly flexible thin tinfoil, the tinfoil blank is joined to the outer cover portion by sticking near a window-like aperture in the box portion.

Other parts belonging to the pack or separate parts which it is required to connect thereto can be secured in this manner.

An embodiment of the invention will be described in greater detail hereinafter with reference to the drawings wherein.

Figure 1:
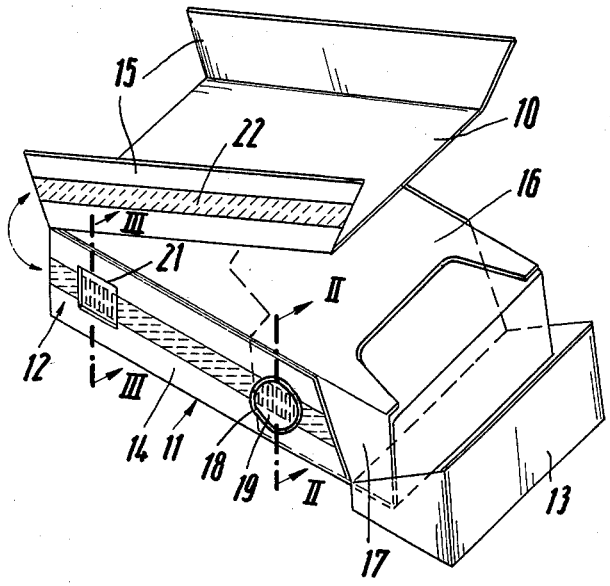
FIG. 1 is a perspective view of a hard pack for cigarettes in an advanced stage of completion.
Figure 2:
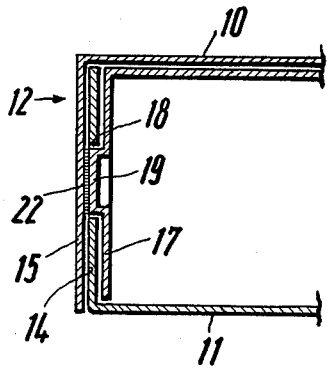
FIG. 2 is a section to an enlarged scale and along the line II—II of FIG. 1 through a finished pack.

The invention is shown in the drawings with reference to a hard pack for cigarettes. Such pack comprises a front wall 10, rear wall 11 and side walls 12. A hinging cover 13 is secured to rear wall 11. No bottom wall is visible in these particular illustrations.

In a pack of this kind the side walls 12 are embodied by two flaps or portions of the front wall 10 and rear wall 12, such flaps being disposed one above another in the completed state. There is an inside box portion 14 which is connected laterally to the rear wall 11, and there is an outer covering portion 15 which is connected laterally to the front wall 10. The pack shown in FIG. 1 is still unfinished in that the front wall 10 still has to be lowered until it abuts the other parts of the pack, whereafter the cover flaps or portions 15, 16 must be folded on to the previously folded box flaps or portions 14.

In the pack shown, and as is conventional in packs of this kind, a collar 16 is introduced into the pack on the open side thereof. As seen in cross-section the collar 16 extends like a U around the pack contents, so that lateral collar flaps or portions 17 arise and extend over some of the zone of the side walls 12. The integers 17 are disposed on the inside — i.e., on the box portions or flaps 14.

It is required to join together the pack layers formed near the collar 16 and its flaps 17. Accordingly, the central layer — i.e., the box protion 14 — is formed in this region with a window-like recess 18. Consequently, the inner flap 17 is immediately adjacent the outer flap 15 in the region of the recess or aperture 18. These two layers — i.e., the integers 15 and 17 — are in direct contact with one another by way of the aperture 18 and the connection, preferably a glued connection, is operative through the aperture 18.

In the case of relatively rigid layers as is the case with a collar 16, one of the layers to be joined together, vis., the inner collar flap 17, has a raised part in the form of a formed-in knob or the like 19 which extends through the aperture 18 and is connected to that side of the cover portion 15 which is near the integer 19.

Figure 3:
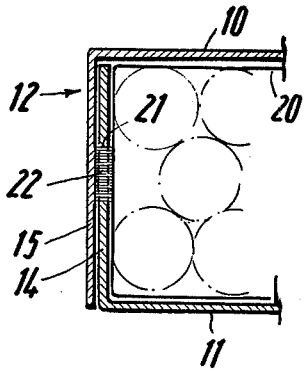
FIG. 3 is a section to an enlarged scale on the line III—III through the finished pack shown in FIG. 1.

As FIGS. 1 and 3 shows, a connection of this kind can be used to locate in the pack a tinfoil blank 20 which is present in the pack and which envelops the cigarettes. The connection is by way of a window-like aperture 21 in the box portion 14, the tinfoil blank 20 being connected directly to the outer covering portion 15 by way of the aperture 21. Since the tinfoil blank 20 is very thin-walled and therefore readily shapable, the blank 20 requires no preliminary stamping but is given the necessary connection to the integer 15 when the pack is assembled, viz., when the outer cover portion 15 is pressed on.

Conveniently, only the outer cover portion 15 has glue applied to it in this pack construction. In the embodiment shown a glue strip 22 is disposed on the inside of the portion 15 and extends near the apertures 18, 21. Consequently, the glue strip 22 serves to join the cover portion 15 to the box portion 14 and to the collar flap 17 and tinfoil blank 20. A single gluing step therefore suffices to join together three layers disposed one above another. The folding and sticking operations are of course relatively simple. In the embodiment in which the collar 16 has knobs or the like 19 near the flaps 17, a factor further simplifying assembly is that when the separate collar 16 is introduced, the protuberances 17 engage in the apertures 18 and thus ensure retention. Accordingly, the protuberances 19 and aperture 18 are so adapted to one another that the protuberance 19 is a postive fit in the aperture 18.

I claim:

1. A flip-top cigarette box including a rear wall (11) having inner side flaps (14) hinged thereto, a front wall (10) having outer side flaps (15) hinged thereto, and a U-shaped insert collar having a front face (16) and side walls (17) hinged thereto, the insert collar adapted to fit within the box in a predetermined position with the front face adjacent the inner surface of the front wall and the side walls adjacent the inner surfaces of the inner side flaps, characterized by:

a. the length of the insert collar being less than the depth of the box, b. a preformed, substantially rigid, outwardly directed stud-like projection (19) on the outer face of each side wall, c. an aperture (18) in each inner side flap shaped and configured to closely mate with a projection when the insert collar is in said predetermined position within the box, whereby the projection is received by and extends into the aperture, and d. adhesive (22) means securing the inner surface of each outer side flap to a projection, whereby the insert collar is securely fixed and retained in said predetermined position.

2. A flip-top cigarette box as defined in claim 1 further characterized by:

a. a foil wrapper (20) enclosing a group of cigarettes inserted within the box, b. a further aperture (21) in each inner side flap beneath the innermost extension of the insert collar when the collar is in said predetermined position, and c. adhesive means securing the inner surface of each outer side flap to the foil wrapper through said further aperture.

* * * * *